US005311637A

United States Patent [19]

Broussard

[11] Patent Number: 5,311,637

[45] Date of Patent: May 17, 1994

[54] VACUUM APPARATUS FOR CLEANING FIREPLACE FLUES

[76] Inventor: Kenneth J. Broussard, Rte. 5, Box 4, Beaumont, Tex. 77713

[21] Appl. No.: 34,522

[22] Filed: Mar. 22, 1993

[51] Int. Cl.[5] ..... F23J 1/00

[52] U.S. Cl. ..... 15/301; 15/353; 15/410; 110/165 R; 126/242

[58] Field of Search ..... 15/301, 353, 410; 110/165 R, 166, 167, 266; 126/16, 242-245

[56] References Cited

U.S. PATENT DOCUMENTS

| | | | |
|---|---|---|---|
| 984,188 | 2/1911 | Brown | 110/165 R |
| 1,465,711 | 8/1923 | Gray | 15/301 X |
| 1,887,768 | 11/1932 | Maloney | 110/165 R X |
| 1,979,873 | 11/1934 | Engstrom . | |
| 3,485,671 | 12/1969 | Stephens | 15/301 X |
| 4,360,947 | 11/1982 | De Cosa et al. | 15/323 |
| 4,476,608 | 10/1984 | Rasmussen | 15/353 |
| 4,497,308 | 2/1985 | Johnson | 126/242 |
| 4,704,764 | 11/1987 | Metelko, Jr. | 126/242 X |
| 4,807,590 | 2/1989 | Evans | 110/165 R X |
| 4,809,391 | 3/1989 | Soldatovic | 15/301 |
| 4,826,514 | 5/1989 | Griffis | 15/353 X |
| 4,868,949 | 9/1989 | Loveless et al. | 15/352 |
| 4,995,137 | 2/1991 | Reichborn | 15/327.1 |

FOREIGN PATENT DOCUMENTS

| | | | |
|---|---|---|---|
| 147822 | 8/1952 | Australia | 15/301 |
| 421664 | 12/1932 | United Kingdom | 15/327 R |
| 470515 | 8/1937 | United Kingdom | 110/165 R |
| 622943 | 5/1949 | United Kingdom | 15/314 |
| 653033 | 5/1951 | United Kingdom | 15/327 R |
| 657160 | 9/1951 | United Kingdom | 15/301 |
| 672970 | 5/1952 | United Kingdom | 15/301 |
| 2219524 | 12/1989 | United Kingdom | 15/353 |

*Primary Examiner*—Harvey C. Hornsby
*Assistant Examiner*—Charles Cooley
*Attorney, Agent, or Firm*—Kenneth A. Roddy

[57] ABSTRACT

A vacuum apparatus for temporary installation in a fireplace or stove of the type having a central opening with a floor at the bottom and a flue at the top thereof for cleaning the flue. The apparatus includes a hollow funnel-shaped adapter member configured at its upper end to generally conform to the size and shape of the bottom portion or throat of the flue of the fireplace and has a bottom end connected by a flexible hose to the inlet of a collection container. The collection container has an outlet which receives the free end of a vacuum cleaner hose which is connected to the intake of a conventional vacuum cleaner. The adapter member is supported by a pair of spring biased telescoping legs which maintain a resilient seal at the top end of the adapter member in sealing relation with the bottom portion or throat of the flue of the fireplace. When the vacuum vacuum cleaner is on, soot, ash, and particles of burned materials dislodged from the interior of the flue by a chimney brush will be drawn into the adapter member, and through the flexible hose, into the interior of the collection container wherein heavier materials will fall to the bottom of the container and lighter materials will be drawn from the container and inducted into the conventional vacuum cleaner and captured by an existing filter in the conventional vacuum cleaner.

10 Claims, 1 Drawing Sheet

VACUUM APPARATUS FOR CLEANING FIREPLACE FLUES

BACKGROUND OF THE INVENTION

1. Field of the Invention

This invention relates generally to fireplace cleaning apparatus, and more particularly to a vacuum apparatus for cleaning fireplaces which fits into the fireplace to engage the flue and is connected to a conventional vacuum cleaner.

2. Brief Description of the Prior Art

The usual procedure for cleaning the flue or flue liner of fireplaces and wood burning stoves is to secure a sheet of plastic material over the firebox or large opening of the fireplace and then a person on the roof of the house inserts a conventional chimney cleaning brush down into the flue from the top end and manipulates the brush to dislodge soot, ash, and particles of the burned materials from the side wall of the flue (and flue liner). The loose soot, ash, and particles fall down onto the hearth (floor) of the fireplace. Usually, much of the lighter soot and ash will escape through the plastic sheet and fill the air in the room in which the fireplace is located, and the larger particles will spill onto the floor of the dwelling.

The dust (soot, ash, and particles) is allowed to settle on the hearth (floor) of the fireplace, and after a considerable period of time, the plastic sheet can be removed. The dislodged materials must then be removed with a small shovel and dumped into a container which also causes the lighter particles to fill the air. After the larger particles have been scooped up, a vacuum cleaner is used to suck up the remaining smaller particles. The air turbulence created by the nozzle of the vacuum cleaner will also swirl the particles into the air.

The above described procedure is dirty, time consuming, inefficient, and often results in damage to the interior of the home. Also, the person doing the cleaning will sometimes inhale quantities of the soot, ash, and other particle of the burned materials into their lungs which is a serious health hazard.

Others have designed apparatus in an attempt to overcome this problem. Evans, U.S. Pat. No. 4,807,590 discloses a fireplace vacuum system which is permanently built into the fireplace and designed to remove ashes to a remote location. Evans teaches permanently mounting a rectangular metal ash collection box within the hearth (floor) of the fireplace by drilling a hole then adding one layer of brick to enclose the ash collection box. A fireproof suction pipe is connected to the collection box and runs through the hearth (fireplace floor), underneath the floor of the house or through an exterior wall into a storage closet where a connection is provided for connecting the pipe to an industrial vacuum cleaner. This apparatus requires extensive modification to the existing fireplace and walls (and floor) of the house and makes no provision for cleaning the flue.

The present invention is distinguished over the prior art in general, and this patent in particular by a vacuum apparatus for temporary installation in a fireplace or stove of the type having a central opening with a floor at the bottom and a flue at the top thereof for cleaning the flue. The apparatus includes a hollow funnel-shaped adapter member configured at its upper end to generally conform to the size and shape of the bottom portion or throat of the flue of the fireplace and has a bottom end connected by a flexible hose to the inlet of a collection container. The collection container has an outlet which receives the free end of a vacuum cleaner hose which is connected to the intake of a conventional vacuum cleaner. The adapter member is supported by a pair of spring biased telescoping legs which maintain a resilient seal at the top end of the adapter member in sealing relation with the bottom portion or throat of the flue of the fireplace. When the vacuum vacuum cleaner is on, soot, ash, and particles of burned materials dislodged from the interior of the flue by a chimney brush will be drawn into the adapter member, and through the flexible hose, into the interior of the collection container wherein heavier materials will fall to the bottom of the container and lighter materials will be drawn from the container and inducted into the conventional vacuum cleaner and captured by an existing filter in the conventional vacuum cleaner.

SUMMARY OF THE INVENTION

It is therefore an object of the present invention to provide a vacuum apparatus for temporary installation in a fireplace or stove of the type having a central opening with a floor at the bottom and a flue at the top thereof for quickly and easily cleaning the flue of the fireplace.

It is another object of this invention to provide a vacuum apparatus for temporary installation in an existing fireplace or stove which does not require modification of the fireplace or stove.

Another object of this invention is to provide a vacuum apparatus for cleaning the flue of a fireplace or stove which will not allow soot, ash, and particles of burned material to fall down onto the hearth (floor) of the fireplace or floor of the dwelling or fill the air in the room in which the fireplace is located.

Another object of this invention is to provide a vacuum apparatus for cleaning the flue of a fireplace or stove which will prevent the person from doing the cleaning from breathing in soot, ash, and particles of burned material.

Another object of this invention is to provide a vacuum apparatus for cleaning the flue of a fireplace or stove which will fit a variety of shapes and sized of fireplaces and stoves and can be connected to a variety of conventional vacuum cleaners.

A further object of this invention is to provide a vacuum apparatus for cleaning the flue of a fireplace or stove which can be easily and quickly erected and disassembled and stored in a small space.

A still further object of this invention is to provide a vacuum apparatus for cleaning the flue of a fireplace or stove which is simple in construction, economical to manufacture and safe in use.

Other objects of the invention will become apparent from time to time throughout the specification and claims as hereinafter related.

The above noted objects and other objects of the invention are accomplished by a vacuum apparatus for temporary installation in a fireplace or stove of the type having a central opening with a floor at the bottom and a flue at the top thereof for cleaning the flue. The apparatus includes a hollow funnel-shaped adapter member configured at its upper end to generally conform to the size and shape of the bottom portion or throat of the flue of the fireplace and has a bottom end connected by a flexible hose to the inlet of a collection container. The collection container has an outlet which receives the free end of a vacuum cleaner hose which is connected to the intake of a conventional vacuum cleaner. The adapter member is supported by a pair of spring biased telescoping legs which maintain a resilient seal at the top end of the adapter member in sealing relation with the bottom portion or throat of the flue of the fireplace. When the vacuum vacuum cleaner is on, soot, ash, and particles of burned materials dislodged from the interior of the flue by a chimney brush will be drawn into the adapter member, and through the flexible hose, into the interior of the collection container wherein heavier materials will fall to the bottom of the container and lighter materials will be drawn from the container and inducted into the conventional vacuum cleaner and captured by an existing filter in the conventional vacuum cleaner.

DESCRIPTION OF THE PREFERRED EMBODIMENT

The following description illustrates and describes the apparatus of the invention in cooperation with a conventional fireplace having a large opening or firebox and a floor or hearth, however, it should be understood that the apparatus may also be used in various other styles of fireplaces and wood burning stoves.

Figure 1:
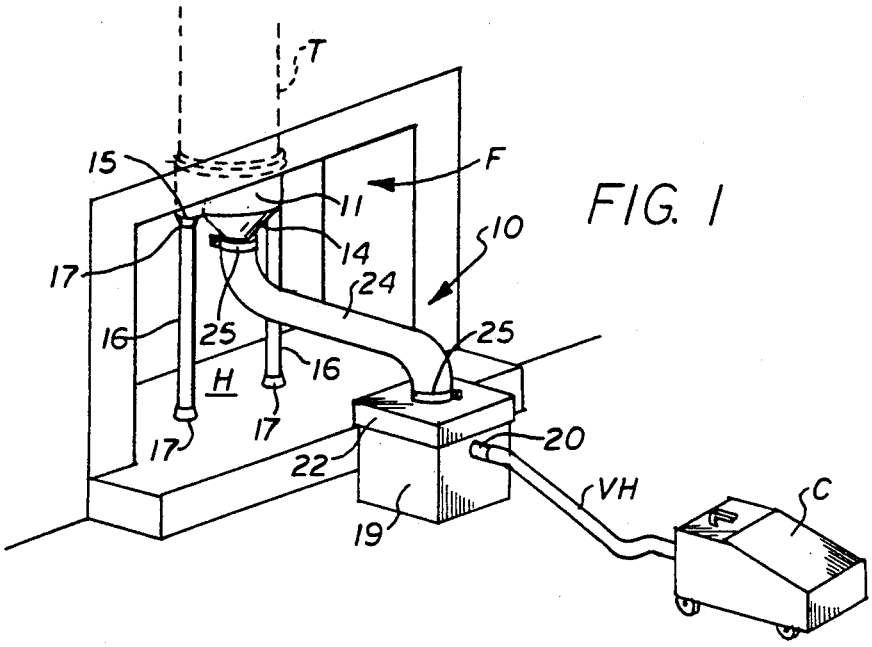
FIG. 1 is a perspective view of a fireplace with the vacuum apparatus in accordance with the present invention installed in the fireplace and connected to a vacuum cleaner.

Referring to the drawings by numerals of reference, there is shown in FIG. 1, a preferred vacuum apparatus 10 in accordance with the present invention installed in the large opening or firebox of a conventional fireplace F and connected to a conventional vacuum cleaner C.

Figure 2:
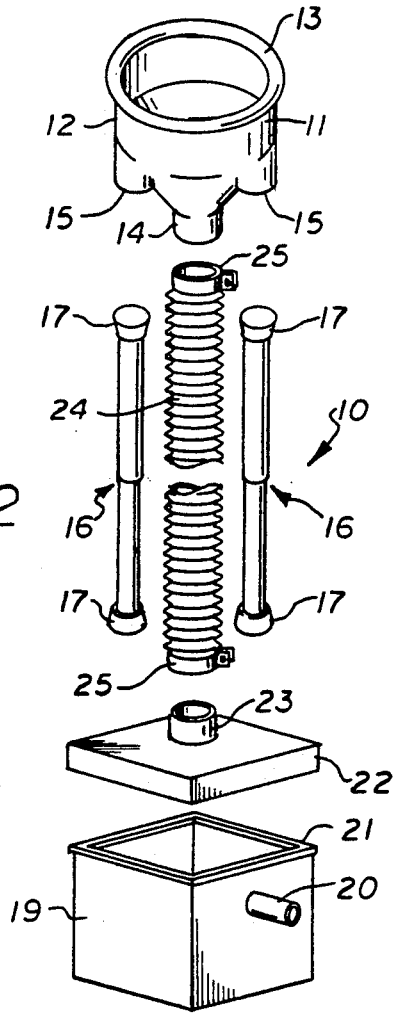
FIG. 2 is an exploded isometric view of the components of the vacuum apparatus.
Figure 3:
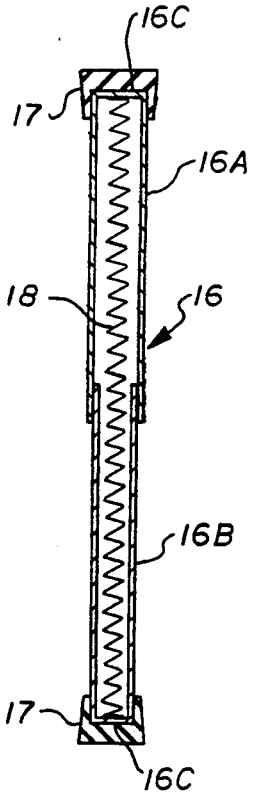
FIG. 3 is a longitudinal cross section of a support leg component of the vacuum apparatus.

Referring additionally to FIGS. 2 and 3, the apparatus 10 has a generally funnel-shaped adapter member 11 open at each end. The adapter member 11 has an upper portion 12 configured to generally conform to the size and shape of the bottom portion or throat T of the flue of the fireplace. A peripheral seal 13 of elastomeric material surrounds the open top end of the adapter member 11 to engage and form a sealing relation on the bottom portion or throat T of the flue. The side wall of the adapter member 11 extends downwardly a distance from the top end, then tapers inwardly and downwardly and terminates in a circular neck or ring 14 surrounding the open bottom end.

In the illustrated embodiment, the adapter member 11 is shown as a generally cylindrical configuration, however, it should be understood that various other shapes may be provided, such as oval or polygonal shapes, to generally conform to the size and shape of the bottom portion or throat of the flue of the fireplace. The seal 13 has a relatively large cross sectional area and is sufficiently flexible to fill any gaps between the adapter body and the bottom portion or throat of the flue of the fireplace.

A pair of horizontal leg support surfaces or shoulders 15 extend outwardly from the exterior of the adapter member 11 in opposed relation. A pair of elongate tubular legs 16 are provided which have resilient end pads 17 at each end. As best seen in FIG. 3, each tubular leg 16 is formed of an outer tubular member 16A which slidably and telescopically receives an inner tubular member 16B. The outer and inner tubular members 16A and 16B each have an end wall 16C at their outer end. A compression spring 18 is carried inside the tubular member 16 and engaged on the end walls 16C to normally urge the outer and inner members 16A and 16B telescopically away from each other.

As described hereinafter, the top ends (end pads 17) of the leg members 16 are to be engaged on the leg support surfaces or shoulders 15 of the adapter member 11 and the bottom ends (end pads 17) are to be placed on the floor or hearth H of the fireplace such that the legs 16 are vertical and the compression spring 16 resiliently urges the adapter member upwardly with sufficient force to force the seal 13 into a sealing relation with the surface of the bottom portion or throat of the flue on which it is engaged.

A collection box 19 having a bottom wall and opposed side walls is provided. The collection box 19 has a tubular extension 20 extending outwardly from one side wall near the upper end. The interior of the tubular extension opens into the collection box 19. The outer end of the tubular extension is sized to be received on the end of a vacuum cleaner hose VH. A peripheral seal 21 of elastomeric material surrounds the open top end of the collection box 19.

A lid member 22 is removably and slidably received on the open top end of the collection box 19 and engages the seal 21. An aperture is formed in the top wall of the lid member 22 and is surrounded by an upstanding circular neck or ring 23. Although a box-like collection box and lid have been shown in the illustrated example, it should be understood that various other collection container shapes may be used.

A length of flexible hose 24 having a hose clamp 25 at each end is connected at one end onto the ring 14 of the adapter member 11 and at its other end onto the ring 23 of the lid 22 of the collection box 19. The flexible hose 24 is preferably formed thin plastic wall material with wire loop reinforcing.

When all the components are connected as described below, a substantially sealed air flow path is established from the interior of the flue pipe, through the adapter member 11, the flexible hose 24, into the interior of the collection box 19, and from the collection box 19 through the tubular extension 20, through the vacuum cleaner hose into the vacuum cleaner.

OPERATION

For safety, it is recommended that the apparatus 10 be used only after the fireplace has coooled down and has not been used for a period of time to prevent hot ashes or particles from entering the system.

To use the apparatus 10 of the present invention, the adapter member 11 is positioned in the opening or firebox of the fireplace F and then lifted upwardly to place the seal 13 at the top end against the bottom portion or throat T of the flue of the fireplace (FIG. 1).

While holding the adapter member 11 in position, the top end (end pad 17) of one leg member 16 is engaged on the leg support surface or shoulder 15 of the adapter member 11 and the bottom end (end pad 17) of the leg is placed on the floor or hearth H and moved inwardly to a generally vertical position. This process is repeated with the other leg. When properly positioned, the compression spring 16 resiliently urges the adapter member upwardly with sufficient force to maintain the adapter member 11 in position and urge the seal 13 into sealing relation with the surface of the bottom portion or throat of the flue on which it is engaged.

The collection box 19 is placed in front of the hearth H of the fireplace and the lid 22 is placed on the collection box. The flexible hose 24 is connected at one end onto the ring 14 of the adapter member 11 and at its other end onto the ring 23 of the lid 22 of the collection box 19, and the hose clamps 25 at each end are tightened to secure the hose connections.

The vacuum hose VH of a conventional vacuum cleaner C is then connected to the tubular extension 20 extending outwardly from the side wall of the collection box 19. The vacuum cleaner is then turned on.

While the vacuum cleaner is running, a person on the roof inserts a conventional chimney cleaning brush down into the flue from the top end and manipulates it in the usual manner to dislodge soot, ash, and particles of the burned materials from the side wall of the flue (and flue liner). The loose soot, ash, and particles are drawn downwardly into the adapter member 11, and through the flexible hose 24, into the interior of the collection box 19. The heavier materials fall to the bottom of the collection box 19 and the lighter materials are drawn from the upper portion of the of the collection box 19 through the tubular extension 20 and into the vacuum cleaner hose VH where they are inducted into the vacuum cleaner C and captured by the existing filter in the vacuum cleaner.

The seal 13 at top end of the adapter member 11, the hose clamps, and the sealed collection box 19 provides a substantially sealed air flow path through the system of apparatus to prevent any loose soot, ash, or particles from entering the room in which the fireplace is located.

After it has been determined that the flue (and flue liner) have been substantially cleaned, the vacuum cleaner is turned off. The vacuum cleaner hose is disconnected from the tubular extension 20 and the lid 22 is removed from the collection box 19 The heavier particles which have been captured in the collection box can then be disposed of in a suitable receptacle in a remote location.

The components of the apparatus can then be disassembled in the reverse order in which they were assembled and stored away until another cleaning operation is desired. The components can be easily stored in a small space or container.

While this invention has been described fully and completely with special emphasis upon a preferred embodiment, it should be understood that within the scope of the appended claims the invention may be practiced otherwise than as specifically described herein.

I claim:

1. A vacuum apparatus for temporary installation in a fireplace or stove of the type having a central opening with a floor at the bottom and a flue at the top thereof which apparatus is to be connected to a conventional vacuum cleaner for cleaning the flue, the apparatus comprising;

a hollow adapter member having an open top end and an upper portion configured to generally conform to the size and shape of the bottom portion or throat of the flue of the fireplace or stove and having an open bottom end;

at least one elongate vertically adjustable tubular leg having a top end engaged on said adapter member and a bottom end engaged on the floor of the fireplace or stove, said at least one tubular leg being extensible for supporting and maintaining said adapter member upper portion in form engagement with the bottom portion or throat of the flue of the fireplace or stove;

a hollow enclosed collection container having an inlet and an outlet, said outlet adapted to be connected to an air intake of the conventional vacuum cleaner; and a length of flexible hole releasably connected at one end to said adapter member open bottom end and releasably connected at its other end to said collection container inlet;

said adapter member, said flexible hose, and said collection container providing an air flow passageway from the interior of the flue of the fireplace or stove, through said adapter member, said flexible hose, into the interior of said collection container, and through said collection container outlet into the air intake of the conventional vacuum cleaner; whereby when the conventional vacuum cleaner is on, soot, ash, and particles of burned materials dislodged from the interior of the flue will be drawn into said adapter member, and through said flexible hose, into the interior of said collection container wherein heavier materials will fall to the bottom of said collection container and lighter materials will be drawn from said collection container and inducted into the conventional vacuum cleaner and captured by an existing filter in the conventional vacuum cleaner.

2. The vacuum apparatus according to claim 1 including resilient seal means at the open top end of said adapter member for engaging and conforming generally to the shape of the bottom portion or throat of the flue and forming a sealing relation therewith.

3. The vacuum apparatus according to claim 1 in which said collection container has a removable lid and seal means therebetween to form a sealing relation between said collection container and said lid when installed thereon.

4. The vacuum apparatus according to claim 3 in which said collection container outlet is a tubular element adapted to be releasably connected to the free end of a vacuum cleaner hose which has its other end connected to the intake of the conventional vacuum cleaner.

5. The vacuum apparatus according to claim 3 in which said collection container inlet is in said removable lid and said collection container outlet is on said collection container.

6. The vacuum apparatus according to claim 1 in which said at least one tubular leg comprises a pair of tubular legs each having a top end engaged on said adapter member and a bottom end engaged on the floor of the fireplace or stove.

7. The vacuum apparatus according to claim 1 including resilient means contained within said at least one tubular leg to maintain said adapter member upper portion in resiliently biased engagement with the bottom portion or throat of the flue of the fireplace or stove and compensate for different vertical distances between the floor and the bottom portion or throat of the flue of the fireplace or stove.

8. The vacuum apparatus according to claim 7 in which said at least one tubular leg comprises a pair of coaxial telescoping tubular members, and said resilient means comprises a spring contained between said telescoping tubular members to normally urge the tubular members away from each other, whereby said top and bottom ends of said at least one tubular leg may be moved toward each other to install said at least one tubular leg and after installation said spring urges said top and bottom ends away from each other to spring bias said adapter member upper portion in engagement with the bottom portion or throat of the flue of the fireplace or stove.

9. A vacuum apparatus for temporary installation in a fireplace or stove of the type having a central opening with a floor at the bottom and a flue at the top thereof which apparatus is to be connected to a conventional vacuum cleaner for cleaning the flue, the apparatus comprising;

a hollow adapter member having an open top end and an upper portion configured to generally conform to the size and shape of the bottom portion or throat of the flue of the fireplace or stove and having an open bottom end;

at least one elongate vertically adjustable tubular leg having a top end engaged on said adapter member and a bottom end engaged on the floor of the fireplace or stove for supporting and maintaining said adapter member upper portion in engagement with the bottom portion or throat of the flue of the fireplace or stove;

resilient means contained within said at least one tubular leg to maintain said adapter member upper portion in resiliently biased engagement with the bottom portion or throat of the flue of the fireplace or stove and compensate for different vertical distances between the floor and the bottom portion or throat of the flue of the fireplace or stove;

a hollow enclosed collection container having an inlet and an outlet, said outlet adapted to be connected to an air intake of the conventional vacuum cleaner; and a length of flexible hose releasably connected at one end to said adapter member open bottom end and releasably connected at its other end to said collection container inlet;

said adapter member, said flexible hose, and said collection container providing an air flow passageway from the interior of the flue of the fireplace or stove, through said adapter member, said flexible hose, into the interior of said collection container, and through said collection container outlet into the air intake of the conventional vacuum cleaner; whereby when the conventional vacuum cleaner is on, soot, ash, and particles of burned materials dislodged from the interior of the flue will be drawn into said adapter member, and through said flexible hose, into the interior of said collection container wherein heavier materials will fall to the bottom of said collection container and lighter materials will be drawn from said collection container and inducted into the conventional vacuum cleaner and captured by an existing filter in the conventional vacuum cleaner.

10. A vacuum apparatus for temporary installation in a fireplace or stove of the type having a central opening with a floor at the bottom and a flue at the top thereof which apparatus is to be connected to a conventional vacuum cleaner for cleaning the flue, the apparatus comprising;

a hollow adapter member having an open top end and an upper portion configured to generally conform to the size and shape of the bottom portion or throat of the flue of the fireplace or stove and having an open bottom end;

at least one elongate vertically adjustable tubular leg having a top end engaged on said adapter member and a bottom end engaged on the floor of the fireplace or stove for supporting and maintaining said adapter member upper portion in firm engagement with the bottom portion or throat of the flue of the fireplace or stove;

said at least one tubular leg comprising a pair of coaxial telescoping tubular members with spring means contained therebetween to normally urge the tubular members away from each other such that said top and bottom ends of said at least one tubular leg may be moved toward each other to install said at least one tubular leg and after installation said spring means urges said adapter member upper portion into resiliently biased engagement with the bottom portion or throat of the flue of the fireplace or stove;

a hollow enclosed collection container having an inlet and an outlet, said outlet adapted to be connected to an air intake of the conventional vacuum cleaner; and a length of flexible hose releasably connected at one end to said adapter member open bottom end and releasably connected at its other end to said collection container inlet;

said adapter member, said flexible hose, and said collection container providing an air flow passageway from the interior of the flue of the fireplace or stove, through said adapter member, said flexible hose, into the interior of said collection container, and through said collection container outlet into the air intake of the conventional vacuum cleaner; whereby when the conventional vacuum cleaner is on, soot, ash, and particles of burned materials dislodged from the interior of the flue will be drawn into said adapter member, and through said flexible hose, into the interior of said collection container wherein heavier materials will fall to the bottom of said collection container and lighter materials will be drawn from said collection container and inducted into the conventional vacuum cleaner and captured by an existing filter in the conventional vacuum cleaner.

* * * * *